US007661802B2

(12) United States Patent
Hara et al.

(10) Patent No.: US 7,661,802 B2
(45) Date of Patent: Feb. 16, 2010

(54) LIQUID DROPLET SPRAYING APPARATUS

(75) Inventors: Koichiro Hara, Nagoya (JP); Atsushi Ito, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 358 days.

(21) Appl. No.: 11/714,376

(22) Filed: Mar. 6, 2007

(65) Prior Publication Data

US 2007/0205306 A1 Sep. 6, 2007

(30) Foreign Application Priority Data

Mar. 6, 2006 (JP) ..... 2006-059804
Mar. 6, 2006 (JP) ..... 2006-059805

(51) Int. Cl.
*B41J 2/045* (2006.01)

(52) U.S. Cl. ..... 347/68

(58) Field of Classification Search ..... 347/68, 347/69–72

See application file for complete search history.

(56) References Cited

U.S. PATENT DOCUMENTS 6,736,493 B2 5/2004 Sekiguchi
2005/0206681 A1 9/2005 Takahashi

FOREIGN PATENT DOCUMENTS

EP 1077331 2/2001
EP 1 361 063 11/2003

*Primary Examiner*—K. Feggins
(74) *Attorney, Agent, or Firm*—Reed Smith LLP

(57) ABSTRACT

A liquid droplet spraying apparatus includes: a plurality of nozzles, a plurality of pressure chambers respectively connected to the nozzles, the pressure chambers each configured to store liquid to which spraying pressure is selectively applied, a common ink chamber that stores the liquid supplied to the pressure chambers; and narrowing portions coupled between the common liquid chamber and the plurality of pressure chambers to supply the liquid therethrough. The narrowing portions are larger in a pressure loss than the common liquid chamber and the plurality of pressure chambers. A ratio of a length of each of the narrowing portions in a liquid flowing direction with respect to a length of corresponding one of the pressure chambers in the liquid flowing direction is 0.34 or more, wherein the liquid flowing direction corresponds to a direction in which the liquid flows through the narrowing portions.

10 Claims, 9 Drawing Sheets

FIG. 4

| NARROWED LENGTH L2 (mm) | PRESSURE CHAMBER LENGTH L1 (mm) | RATIO OF NARROWED LENGTH TO PRESSURE CHAMBER LENGTH L2/L1 (mm) | MINIMUM DROPLET VOLUME V1 (pl) | MAXIMUM DROPLET VOLUME V2 (pl) | RATIO OF MINIMUM/ MAXIMUM DROPLET VOLUMES V2/V1 |
|---|---|---|---|---|---|
| 0.35 | 3.92 | 0.09 | 5 | 35 | 7 |
| 0.55 | 2.96 | 0.19 | 3 | 24 | 8 |
| 0.70 | 1.42 | 0.49 | 2 | 24 | 12 |

FIG. 5

| NARROWED LENGTH (mm) | PRESSURE CHAMBER LENGTH (mm) | RATIO OF NARROWED LENGTH TO PRESSURE CHAMBER LENGTH (mm) | | 100% DUTY | 50% DUTY | COMBINATION |
|---|---|---|---|---|---|---|
| 0.70 | 1.42 | 0.49 | 1 | ○ | ○ | ○ |
| 0.60 | 1.42 | 0.42 | 2 | ○ | ○ | ○ |
| 0.50 | 1.42 | 0.35 | 3 | ○ | ○ | ○ |
| 0.40 | 1.42 | 0.28 | 4 | ○ | △ | × |
| 0.30 | 1.42 | 0.21 | 5 | ○ | △ | × |
| 0.20 | 1.42 | 0.14 | 6 | △ | × | × |
| 0.10 | 1.42 | 0.07 | 7 | × | × | × |

FIG. 7A

| WIDTH D2 (mm) | DEPTH D1 (mm) | ASPECT RATIO D2/D1 | STABLE MAP MARK | VOLUME (pl) |
|---|---|---|---|---|
| 0.066 | 0.024 | 2.75 | 43.30 | 19.00 |
| 0.072 | 0.026 | 2.77 | 33.00 | 22.00 |
| 0.085 | 0.030 | 2.83 | 27.80 | 25.80 |
| 0.087 | 0.030 | 2.90 | 27.50 | 26.80 |
| 0.092 | 0.031 | 2.97 | 28.30 | 26.70 |
| 0.088 | 0.028 | 3.14 | 31.30 | 26.50 |
| 0.088 | 0.027 | 3.26 | 35.80 | 26.20 |

S1 →

P2 ↓

| | S1a | S1b | S1c | S1d | S1e | S1f | ... | ... |
|---|---|---|---|---|---|---|---|---|
| P2a | × | × | △ | ○ | ○ | ○ | | |
| P2b | × | △ | ○ | ○ | ○ | ○ | | |
| P2c | △ | ○ | ○ | ○ | ○ | ○ | | |
| P2d | ○ | ○ | ○ | ○ | ○ | ○ | | |
| P2e | ○ | ○ | ○ | ○ | ○ | ○ | | |
| P2f | ○ | ○ | ○ | ○ | △ | △ | | |
| ... | | | | | | | | |
| ... | | | | | | | | |

LIQUID DROPLET SPRAYING APPARATUS

CROSS-REFERENCE TO RELATED APPLICATIONS

The entire disclosure of Japanese Patent Application Nos. 2006-059804 and 2006-059805 filed on Mar. 6, 2006 including specifications, claims, drawings and abstracts is incorporated herein by reference in its entirety.

BACKGROUND

1. Field

One embodiment of the present invention relates to a liquid droplet spraying apparatus for spraying liquid droplets from nozzles connected to pressure chambers by selectively applying spraying pressure to the pressure chambers storing liquid using an actuator.

2. Description of the Related Art

Conventionally, it is known an inkjet recording apparatus for carrying out recording on a recording medium using ink by scanning ahead unit for spraying ink droplets over the recording medium faced on the head unit. The head unit is provided with a plurality of pressure chambers for storing ink, common ink chambers for supplying ink to the respective pressure chambers, a piezoelectric actuator disposed adjacent to the respective pressure chambers, and a drive circuit for driving this piezoelectric actuator; the piezoelectric actuator driven using the drive circuit selectively applies spraying pressure to the pressure chambers so that ink droplets are sprayed to the recording medium from nozzles connected to the pressure chambers.

When spraying pressure is applied to the ink inside the pressure chamber using the piezoelectric actuator, the ink moves toward the nozzle and simultaneously tends to move from the pressure chamber to the ink supply side, that is, the upstream side. As the movement of the ink in a direction opposite to the spraying direction lowers spraying efficiency, such movement should be restricted as much as possible. After the ink droplets are sprayed, pressure inside the pressure chamber should be lowered so that excess ink is not sprayed.

Hence, conventionally, the pressure loss of the pressure chamber or the nozzles among the ink flow passages formed inside the head unit is made higher than those of the other sections so that the pressure inside the pressure chamber is lowered after ink spraying and so that stable ink droplets are discharged.

However, in the conventional methods described above, in order to obtain a sufficient pressure loss in the pressure chamber, an increased length or a very small cross-section area of the pressure chamber is required, thereby causing the following problems.

First, when the length of the pressure chamber is increased, the entire size of the head unit becomes larger, and the period of pressure fluctuation becomes longer. This results in a limitation in the speed of recording. Next, when the sectional area of the pressure chamber is made very small, larger pressure must be applied to the pressure chamber to obtain an ink droplet having a predetermined volume, and very large negative pressure is generated inside the pressure chamber. This impairs spraying stability. Furthermore, when the proportion of the pressure loss on the nozzle side is made higher, the proportion of the sprayed liquid droplet volume with respect to the generated pressure becomes smaller; as a result, the spraying speed rises excessively, and the meniscus inside the nozzle is liable to collapse.

For these reasons, a configuration has been devised conventionally in which the common ink chamber is connected to the pressure chamber using a narrowing portion serving as an ink passage. Since the narrowing portion has a pressure loss larger than those of the common liquid chamber and the pressure chamber, a sufficient pressure loss is obtained without increasing the length of the pressure chamber more than necessary and without making the sectional area of the pressure chamber very small in comparison with the conventional configuration. As a result, when pressure is applied to the ink inside the pressure chamber using a piezoelectric actuator, the flow of the ink toward the nozzle can be generated efficiently. Furthermore, after the ink is sprayed, the pressure inside the pressure chamber is lowered so that excess ink is prevented from being sprayed, whereby recording can be carried out with excellent spraying efficiency at high speed.

SUMMARY

However, in recent years, inkjet recording apparatuses have been demanded to have higher expressive power. More specifically, they have been demanded to carry out recording in a wider gradation range at a higher drive frequency.

Accordingly, one embodiment of the present invention provides a liquid droplet spraying apparatus capable of carrying out recording in a gradation range wider than the conventional range, and capable of spraying liquid droplets at a drive frequency higher than the conventional frequency.

According to one aspect of the invention, a liquid droplet spraying apparatus, includes: a plurality of nozzles that spray liquid droplets; a plurality of pressure chambers respectively connected to the plurality of nozzles, the pressure chambers each configured to store liquid to which spraying pressure is selectively applied; a common liquid chamber that stores the liquid to be supplied to the plurality of pressure chambers; and narrowing portions that are coupled between the common liquid chamber and the plurality of pressure chambers to supply the liquid from the common liquid chamber to the plurality of pressure chambers, the narrowing portions being larger in a pressure loss than the common liquid chamber and the plurality of pressure chambers. A ratio of a length of each of the narrowing portions in a liquid flowing direction with respect to a length of corresponding one of the pressure chambers in the liquid flowing direction is 0.34 or more, wherein the liquid flowing direction corresponds to a direction in which the liquid flows the narrowing portions.

According to another aspect of the invention, a liquid droplet spraying apparatus, includes: a plurality of nozzles that spray liquid droplets; a plurality of pressure chambers respectively connected to the plurality of nozzles, the pressure chambers each configured to store liquid to which spraying pressure is selectively applied; a common liquid chamber that stores the liquid to be supplied to the plurality of pressure chambers; and narrowing portions that are coupled between the common liquid chamber and the plurality of pressure chambers to supply the liquid from the common liquid chamber to the plurality of pressure chambers, the narrowing portions being larger in pressure loss than the common liquid chamber and the plurality of pressure chambers; wherein each of the narrowing portions is shorter in length than the pressure chamber in a liquid flowing direction, the liquid flowing direction corresponding to a direction in which the liquid flows through the narrowing potions; and a ratio of a width to a depth of the narrowing portion is 2.9 or more.

BRIEF DESCRIPTION OF THE DRAWINGS

Embodiment may be described in detail with reference to the accompanying drawings, in which:

FIGS. 3A-3C are fragmentary illustrative sectional views showing the head unit held on the head holder, taken along arrow 3-3 in FIG. 2, wherein FIG. 3A is the fragmentary illustrative view, FIG. 3B is an illustrative view showing a pressure chamber and a narrowing portion, and FIG. 3C is an illustrative view showing the narrowing portion;

FIG. 4 is a table summarizing data obtained by the first experiment;

FIG. 5 is a table summarizing data obtained by the second experiment;

FIG. 7A is a table summarizing data obtained by the third experiment;

DETAILED DESCRIPTION

Figure 1:
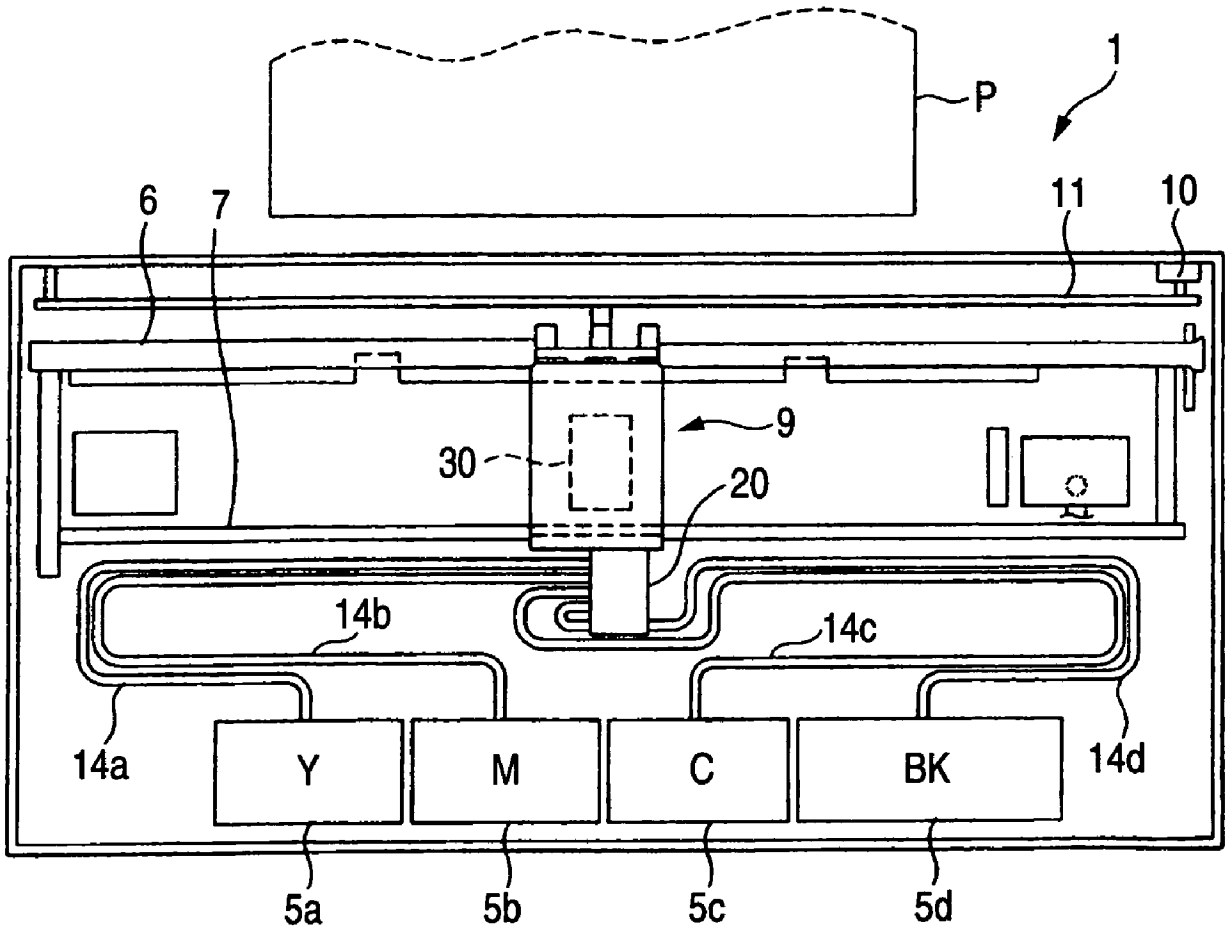
FIG. 1 is a plan illustrative view showing the main configuration of an inkjet recording apparatus according to one embodiment of the invention.

An embodiment according to the present invention will be described referring to the drawings.

[Main Configuration]

First, the main configuration of an inkjet recording apparatus will be described referring to FIG. 1. FIG. 1 is a plan illustrative view showing the main configuration of the inkjet recording apparatus.

Inside the inkjet recording apparatus 1, two guide shafts 6 and 7 are provided, and a head holder 9 also serving as a carriage is installed on the guide shafts 6 and 7. On the head holder 9, a head unit 30 for spraying ink onto a recording sheet of paper P to carry out recording is held on the head holder 9. The head holder 9 is installed on an endless belt 11 that is rotated using a carriage motor 10, and is moved along the guide shafts 6 and 7 by the drive of the carriage motor 10.

Furthermore, the inkjet recording apparatus 1 is provided with an ink tank 5*a* for storing yellow ink, an ink tank 5*b* for storing magenta ink, an ink tank 5*c* for storing cyan ink, and an ink tank 5*d* for storing black ink. The ink tanks 5*a* to 5*d* are connected to flexible ink supply tubes 14*a*, 14*b*, 14*c* and 14*d*, respectively, and ink supplied from each ink supply tube is introduced into the head unit 30 via a tube joint 20 extended forward from the head holder 9. Pigment ink or dye ink can be used as the ink for each color.

[Structure of the Head Unit]

Next, the structure of the head unit 30 will be described referring to FIG. 2 and FIGS. 3A-3C.

Figure 2:
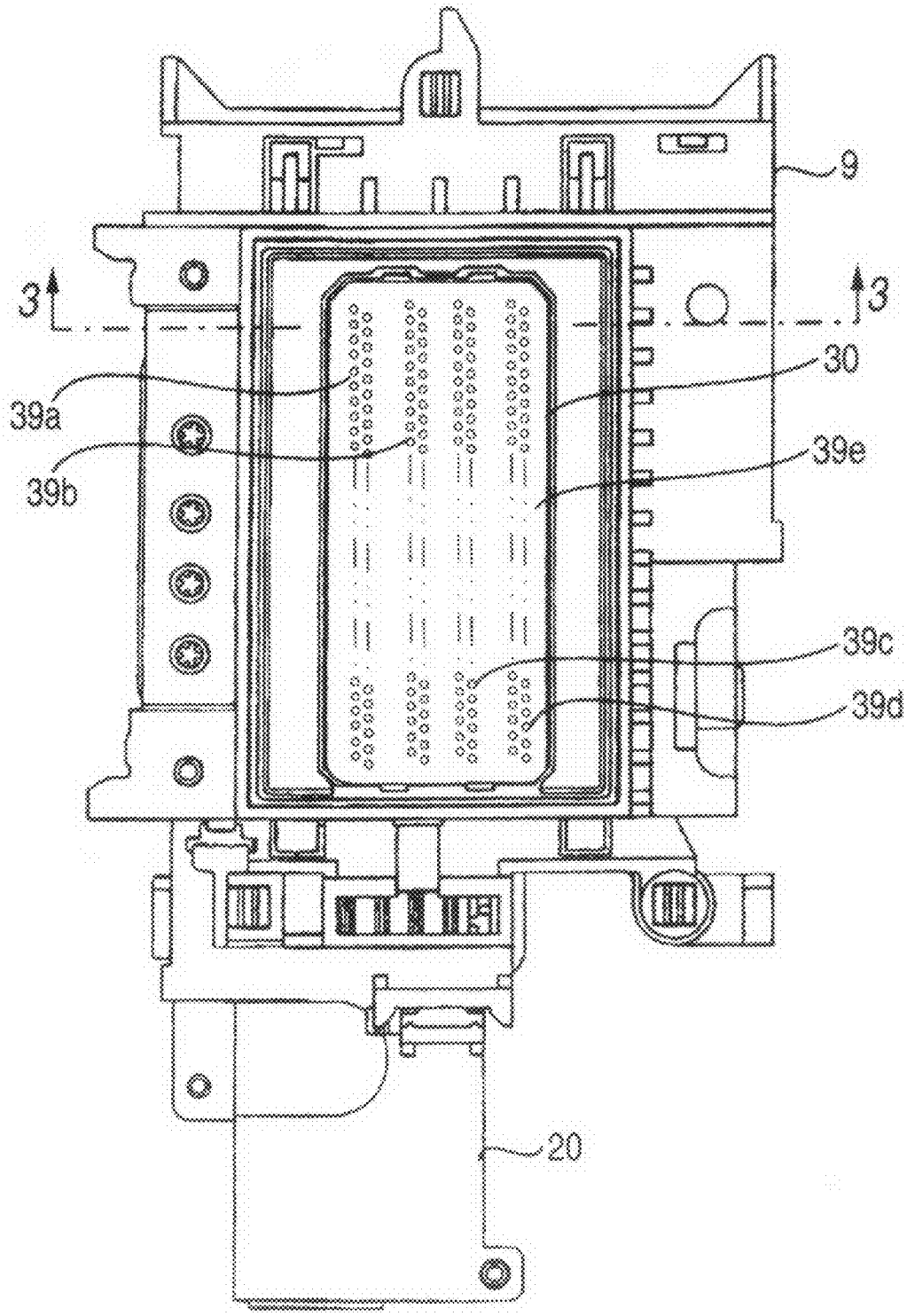
FIG. 2 is a plan view showing a head holder viewed from the nozzle surface side.
Figure 3A:
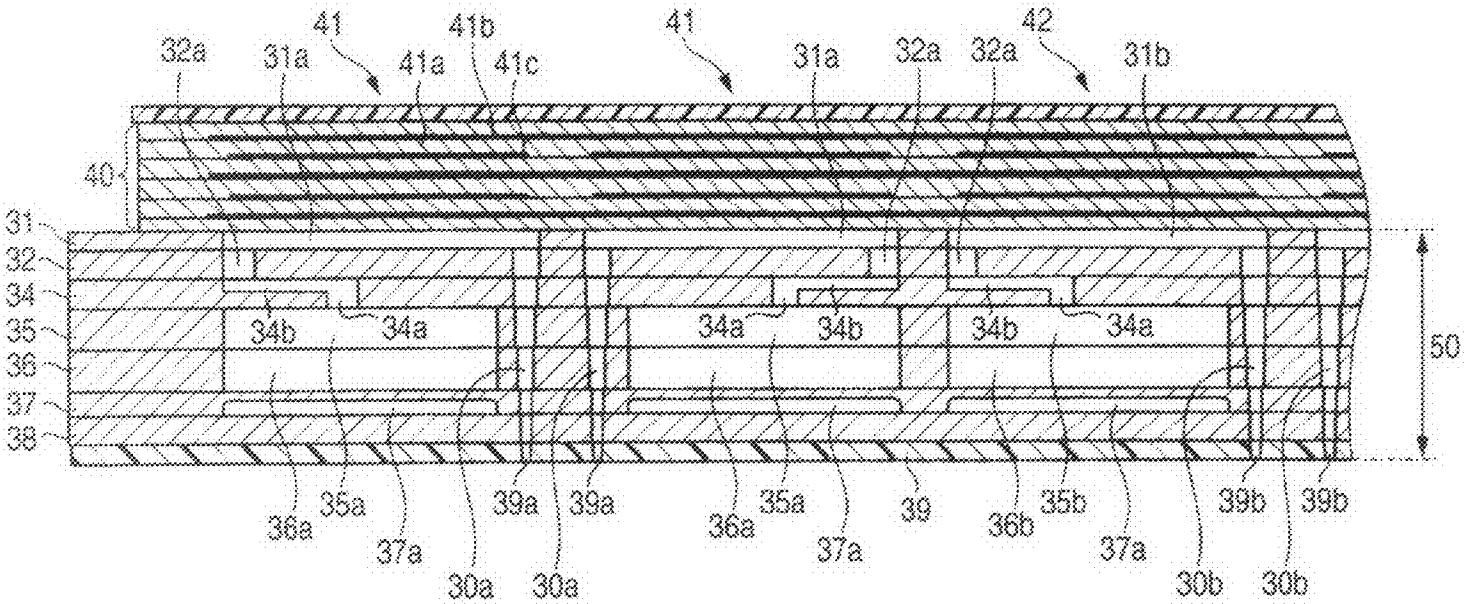
Figure 3C:
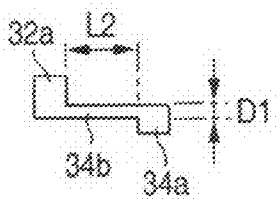
Figure 3B:
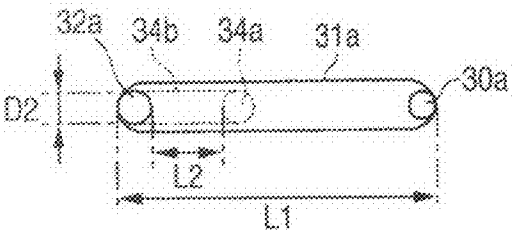

FIG. 2 is a plan view showing the head holder 9 viewed from the nozzle surface side. FIGS. 3A-3C are fragmentary illustrative sectional views showing the head unit held on the head holder 9, taken along arrow 3-3 in FIG. 2; wherein FIG. 3A is the fragmentary illustrative view, FIG. 3B is an illustrative view showing a pressure chamber and a narrowing portion, and FIG. 3C is an illustrative view showing the narrowing portion. In the following description, the ink spraying direction is downward.

As shown in FIG. 2, on a nozzle surface 39*e* formed on the lower surface of the head unit 30, nozzles 39*a* for spraying black ink, nozzles 39*b* for spraying yellow ink, nozzles 39*c* for spraying cyan ink, and nozzles 39*d* for spraying magenta ink are respectively disposed in two rows so as to extend in a direction perpendicular to the movement direction (main scanning direction) of the head holder 9. Each nozzle is open downward so as to be opposed to the upper surface of the recording sheet of paper P (FIG. 1) serving as a recording medium.

As shown in FIG. 3A, the head unit 30 is configured by bonding a piezoelectric actuator 40 to the upper surface of a cavity unit 50. The cavity unit 50 has a structure in which a total of eight thin plates, a nozzle plate 39, a spacer plate 38, a damper plate 37, manifold plates 36 and 35, a supply plate 34, a base plate 32, and a cavity plate 31, are laminated in this order beginning from the bottom and bonded together. A bonding means, such as adhesive, is applicable to the bonding between the respective plates and the bonding between the cavity unit 50 and the piezoelectric actuator 40.

The piezoelectric actuator 40 includes active parts 41 and 41 for generating energy for spraying black ink and an active part 42 for generating energy for spraying yellow ink. In reality, on the right side of the active part 42, another active part 42 is disposed although it is not shown in FIG. 3A; on the right thereof, two active parts for generating energy for spraying cyan ink are disposed, and on the further right thereof, two active parts for generating energy for spraying magenta ink are disposed. The active part is herein a part that is included in the piezoelectric actuator and acts to apply pressure to the ink inside the pressure chamber and to spray the ink.

The piezoelectric actuator 40 includes piezoelectric sheets made of a piezoelectric material and film electrodes, laminated alternately. The active part 41 is formed of a piezoelectric sheet portion 41*a* held between electrodes 41*b* and 41*c* in the vertical direction, and other active parts are also formed similarly.

Common ink chambers for supplying ink to respective pressure chambers are formed inside the manifold plates 36 and 35 below the respective active parts. Below the active part 41 and inside the manifold plates 36 and 35, common ink chambers 36*a* and 35*a* for storing black ink are formed. Below the active part 42 and inside the manifold plates 36 and 35, common ink chambers 36*b* and 35*b* for storing yellow ink are formed. Inside the manifold plates disposed below another active part, common ink chambers for storing ink that is sprayed using the active part are formed, although they are not shown.

The head holder 9 is provided with a relay tank (not shown) having a relay ink chamber for storing bubbles contained in ink supplied from each of the ink tanks 5*a* to 5*d* (FIG. 1), and ink is supplied from each of the ink tanks 5*a* to 5*d* via the relay tank to an ink supply port (not shown) that supplies ink to each common ink chamber.

Narrowing portions 34*b* are formed inside the supply plate 34 disposed above the respective common ink chambers. Each of the narrowing portions 34*b* is formed into a groove shape along the upper flat surface of the supply plate 34. The end portion of each narrowing portion 34*b* on the ink inflow side is coupled to each common ink chamber via a through hole 34*a* formed so as to pass through in the vertical direction.

Furthermore, above the supply plate 34, the base plate 32 is laminated so as to cover the longitudinal open surfaces of the respective narrowing portions 34*b*. Pressure chambers 31*a* are formed inside the cavity plate 31 laminated on the base plate 32 at portions being opposed to the lower surfaces of the respective active parts. Each pressure chamber 31*a* is coupled to the end portion of the narrowing portion 34*b* on the ink outflow side via a through hole 32*a* formed so as to pass in the vertical direction through the base plate 32 disposed between the cavity plate 31 and the supply plate 34.

Above the common ink chamber 35*a* for storing black ink, the narrowing portion 34*b* is formed, and the narrowing portion 34*b* is coupled to the common ink chamber 35*a* via the through hole 34*a* and is further coupled to the pressure chamber 31*a* via the through hole 32*a*.

The vertical sectional area of the narrowing portion 34*b* is made smaller than the vertical sectional area of the pressure chamber coupled thereto, whereby the pressure loss thereof is set so as to be larger than those of the common ink chamber and the pressure chamber. In other words, the narrowing portion 34*b* plays a role so that a pressure fluctuation component that is included in pressure fluctuation generated in the pressure chamber coupled therewith and applied to the common ink chamber is relieved.

In the lower surface of the damper plate 37 disposed below the respective common ink chambers, damper chambers 37*a* are formed. Each damper chamber 37*a* is formed so as to be open downward at the lower surface of the damper plate 37, and the transverse sectional shape of the damper chamber 37*a* is made identical with the transverse sectional shape of the lower surface of the common ink chamber adjacent to the damper plate 37.

The damper plate 37 is made of a material, such as a metal that can be deformed elastically, and the thin plate-like bottom plate portion in the upper portion of the damper chamber 37*a* can freely vibrate to the common ink chamber side and to the damper chamber side. Even if the pressure fluctuation generated in the pressure chamber at the time of ink droplet spraying is propagated to the common ink chamber, the bottom plate portion is elastically deformed and vibrates, thereby having a damper effect of absorbing and damping the above-mentioned pressure fluctuation and producing an effect of preventing crosstalk, that is, the propagation of the pressure fluctuation to the other pressure chambers.

A through hole 30*b* for leading the ink inside the pressure chamber into the nozzles is formed in the vertical direction so as to mutually pass through the plates 32 to 38 disposed between the cavity plate 31 and the nozzle plate 39. As shown in the drive waveform of FIG. 7B, it is preferable that a voltage (22 V) is applied across the electrodes 41*b* and 41*c* of the above-mentioned piezoelectric actuator 40 during non-spraying time to extend the active part and to reduce the volume of the pressure chamber, that the application of the voltage is selectively stopped at the time of spraying to expand the volume of the pressure chamber, and that the voltage is applied again after a predetermined period to apply the spraying pressure to the ink inside the pressure chamber. The pulse widths P1 and P2 and the space S1 of the pulses (spraying pulses) consisting of the rising and the falling of the voltage are selected from values obtained as results of an experiment in which the period is shifted in small steps from half of the natural vibration period of the ink in the pressure chamber. It may also be possible that the voltage is not normally applied and that the voltage is applied to expand the active part and to apply the spraying pressure to the ink.

[First Experiment]

Next, a first experiment conducted by the inventors of the present application will be described.

The inventors of the present application examined the relationship between the narrowing portion 34*b* and the pressure chamber 31*a* required to widen the range of the gradation capable of being reproduced on a recording sheet of paper.

As shown in FIG. 3B, the length of the narrowing portion 34*b* (hereinafter referred to as "narrowed length") corresponding to the ink flowing direction was designated by L2, and the length of the pressure chamber 31*a* (hereinafter referred to as "pressure chamber length") corresponding to the ink flowing direction was designated by L1. Furthermore, as a method for obtaining the range of gradation, the ratio of the maximum liquid droplet volume V2 and the minimum liquid droplet volume V1 (hereinafter referred to as "liquid droplet volume ratio") (V2/V1) of the ink droplet capable of being sprayed from the nozzle was used while the drive waveform was set variously. The liquid droplet volume ratio (V2/V1) was then obtained while the ratio between the narrowed length L2 and the pressure chamber length L1 (hereinafter referred to as "length ratio") (L2/L1) was changed. The results of the experiment are shown in FIG. 4 and FIG. 6.

In the experiment, the width (the width in a direction perpendicular to the length L1 in the plan view) of the pressure chamber 31*a* was fixed to 0.27 mm, the depth thereof (the thickness of the cavity plate 31) was fixed to 0.05 mm, the width of the narrowing portion 34*b* was fixed to 0.085 mm, the depth thereof was fixed to 0.03 mm, and the diameter of the nozzle 39*a* was fixed to 0.02 to 0.03 mm. In addition, the room temperature was set at 25° C., and the viscosity of the ink was set at 2 to 5 cps. (The diameter of the nozzle 39*a*, room temperature, and the viscosity of the ink are also the same in the following experiment.)

As shown in the figures, when the narrowed length L2 was 0.55 mm, the pressure chamber length L1 was 2.96 mm, and when the length ratio (L2/L1) was 0.19, the minimum liquid droplet volume V1 was 3 pl (picoliter), and the maximum liquid droplet volume V2 was 24 pl; hence, the liquid droplet volume ratio (V2/V1) was 8. Furthermore, when the narrowed length L2 was 0.70 mm, the pressure chamber length L1 was 1.42 mm, and when the length ratio (L2/L1) was 0.49, the minimum liquid droplet volume V1 was 2 pl (picoliter), and the maximum liquid droplet volume V2 was 24 pl; hence, the liquid droplet volume ratio (V2/V1) was 12.

Figure 6:
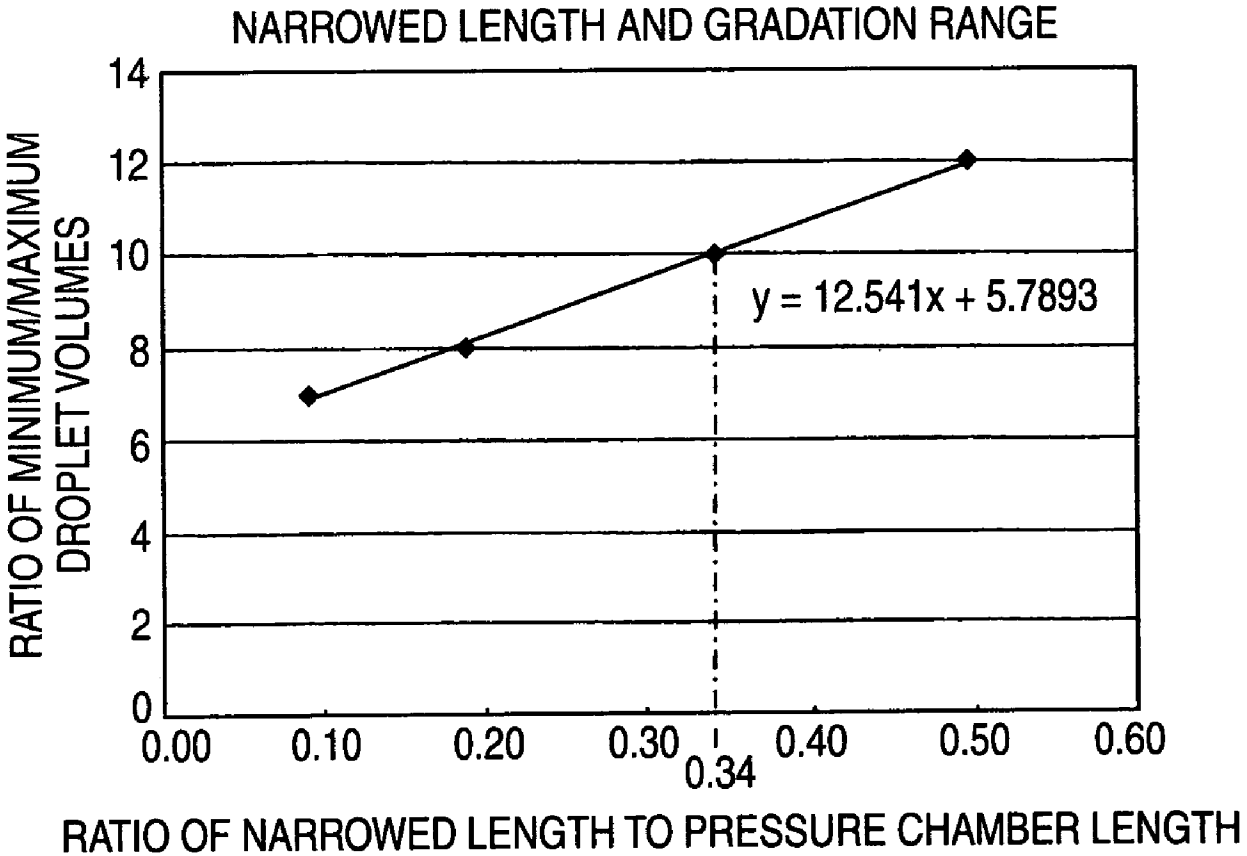
FIG. 6 is a graph obtained by plotting experiment data shown in FIG. 4 on coordinates.

The experiment data shown in FIG. 4 was plotted on coordinates wherein the liquid droplet volume ratio is represented by the vertical axis (the y-axis) and the length ratio is represented by the horizontal axis (the x-axis), and the graph shown in FIG. 6 was obtained by connecting the plots. The coordinates in this graph have a relationship of $y=12.541x+5.7893$.

When it is assumed that the wide gradation range that should be obtained is attained when the liquid droplet volume ratio is 10 or more, it has been found that the length ratio should be 0.34 or more to obtain a liquid droplet volume ratio of 10 or more. For example, in the experiment of this time, when the narrowed length L2 is set to 0.70 mm and the pressure chamber length L1 is set to 1.42 mm as shown in FIG. 4, a length ratio of 0.49, higher than 0.34, can be obtained, and the liquid droplet volume ratio becomes 12, whereby the wide gradation range that should be obtained can be attained. In addition, the drive frequency was able to be set at a high value of 26 kHz.

[Second Experiment]

Furthermore, the inventors of the present application conducted an experiment to examine the influence of the length ratio on the quality of recording.

FIG. 5 is a table showing the results of the experiment. The quality of recording was observed when the length ratio was changed and the printing duty (Duty) was made different. The printing duty herein represents the ratio of the number of dots actually recorded (printed) to the drive period for forming dots on the basis of printing data; in other words, the duty is 100% when dot formation is carried out at each drive period (so-called daubing), and the duty is 50% when dot formation is carried out at every other drive period. "Combination" in the figure indicates that recording was carried out while the printing duty was changed continuously. The experiment was conducted at a drive frequency of 26 kHz. In the figure, an X represents a state in which ink sprayed from numerous nozzles did not form normal droplets, but splashed or deviated in the spraying direction; a triangle represents a state in which the above-mentioned phenomenon occurred in several nozzles; and a circle represents a state in which stable spraying was able to be carried out for all the nozzles.

The width and depth of the pressure chamber 31*a* and the width and depth of the narrowing portion 34*b* in the second experiment were the same as those in the first experiment.

As results of the experiment, it was found that the quality of recording becomes high regardless of printing duty when the length ratio is 0.35 or more. In the experiment, the quality of recording was not tested at a length ratio of 0.34; however, since the difference from a length ratio of 0.35 at which the quality was tested is only 0.01, it is assumed that the same effect as that obtained when the length ratio was set at 0.35 would be obtained.

In addition, according to various experiments conducted by the inventors, several products of the same kind were made, and they had dimensional variations in actual machining, but they had no difference in characteristics. Hence, the above-mentioned difference is small enough to ignore and is within the margin of error in machining.

In other words, through the first and second experiments, it was found that high-quality recording can be carried out in a wide gradation range by setting the length ratio at 0.34 or more. Furthermore, at this time, it was also found that the spraying speed can be set at 5 to 15 m/s, values causing no problem in practice.

[Third Experiment]

Next, the inventors of the present application conducted an experiment to examine the influence of the aspect ratio of the narrowing portion 34*b* on the quality of recording obtained when recording is performed at high speed (26 kHz, the above-mentioned value).

In this experiment, the length L1 of the pressure chamber 31*a* was fixed to 1.42 mm, the width thereof was fixed to 0.27 mm, the depth thereof was fixed to 0.05 mm, and the length L2 of the narrowing portion 34*b* was fixed to 0.7 mm.

The aspect ratio of the narrowing portion 34*b* is represented by the ratio (D2/D1) of the width D2 of the narrowing portion 34*b* in the transverse direction perpendicular to the longitudinal direction to the depth D1 of the narrowing portion 34*b* as shown in FIG. 3C.

The experiment was conducted to examine whether stable spraying was possible while the ink droplet volume to be sprayed was maintained at a predetermined amount when recording was performed at high speed while the aspect ratio was changed.

Figures 7B, 7C:
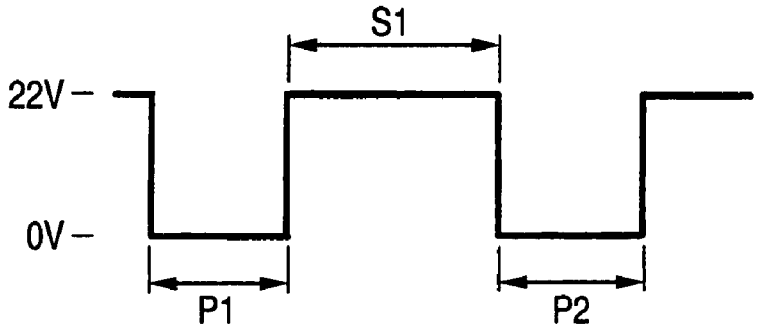
FIG. 7B is a drive waveform used in the experiment.
FIG. 7C is a table summarizing the experimental results indicating the spraying stability when the pulse width and the pulse space are changed.
Figure 8:
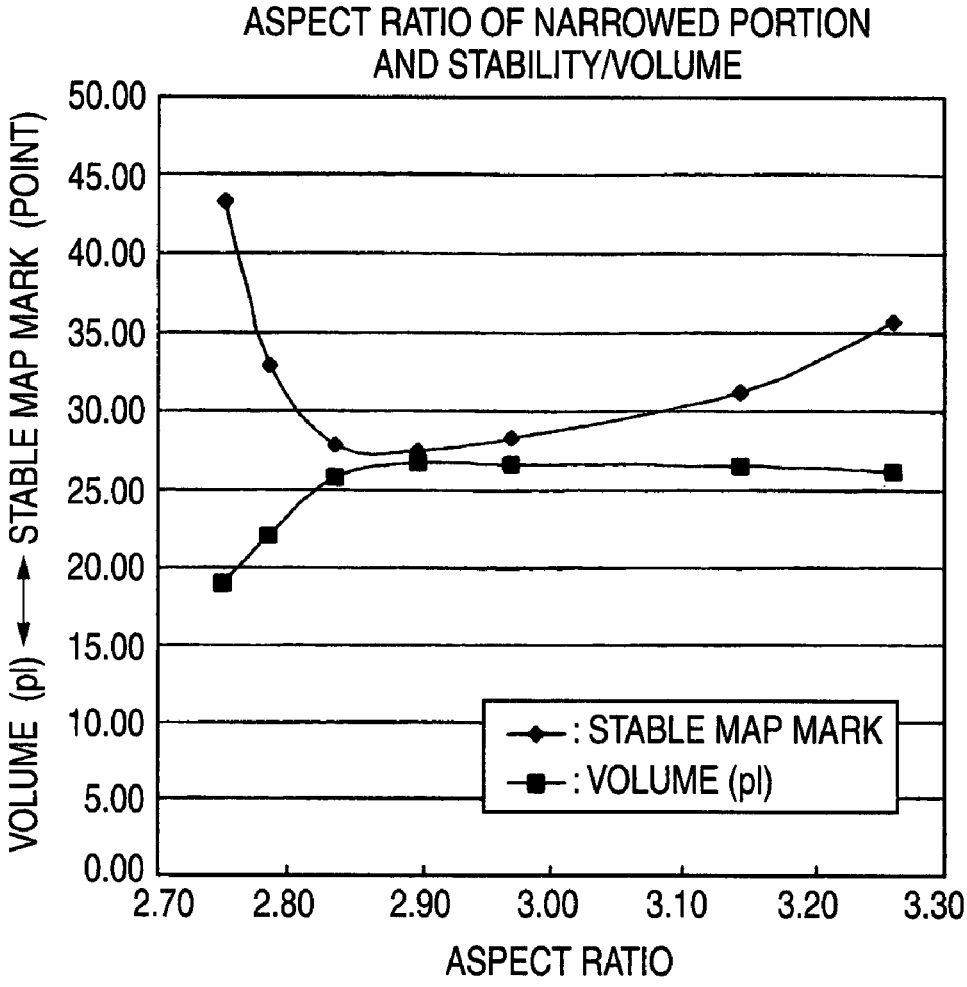
FIG. 8 is a graph obtained by plotting the data shown in FIGS. 7A-7B on coordinates.

The experiment was conducted to examine the change in a stable map mark and the change in ink droplet volume sprayed when the aspect ratio was changed. The stable map marks are herein obtained by quantifying the spraying stability when spraying is performed while the pulse width and the pulse space of the drive waveform shown in FIG. 7B were changed variously. In other words, the pulse width P1 of the first droplet spraying pulse in the drive waveform shown in FIG. 7B was fixed, the pulse width P2 of the second droplet spraying pulse was changed to P2*a*, P2*b*, P2*c*, . . . as shown in FIG. 7C, and the space S1 between the two spraying pulses was changed to S1*a*, S1*b*, S1*c*, . . . , and then the spraying stability in the respective combinations was checked at the respective printing duties, as in the case of the experiment shown in FIG. 5. At that time, two points were given to a circle, one point was given to a triangle, and zero points were given to an X, and the points were totaled to obtain the stable map marks shown in FIG. 7A. In addition, the liquid droplet volume is a volume obtained when the above-mentioned two droplets were combined. FIG. 8 is a graph of the data shown in FIG. 7A.

According to results of the experiment, it was found that as the aspect ratio increases, the stable map mark tends to decrease abruptly at first and then changes moderately after the aspect ratio becomes 2.90. Furthermore, it was found that as the aspect ratio increases, the ink droplet volume increases abruptly at first and becomes nearly constant after the aspect ratio becomes 2.90.

In other words, according to the third experiment, by setting the aspect ratio of the narrowing portion 34*b* at 2.90 or more, nearly constant spraying performance can be securely obtained in which the maximum volume required for an ink droplet to be sprayed is securely obtained, and the liquid droplet volume becomes nearly constant as described above even if the width and depth of the narrowing portion have variations in the case of a drive waveform according to which stable spraying is made possible although the stable map mark is low; hence, production can be carried out easily.

Moreover, the ink droplet spraying speed was able to be set at 5 to 15 m/s, values causing no problem in practice.

[Effects of Embodiment]

(1) As described above, with the use of the inkjet recording apparatus 1 according to the above-mentioned embodiment, the gradation range of a recording area can be expanded by setting the length ratio (L2/L1) at 0.34 or more.

(2) In addition, by setting the aspect ratio (D2/D1) of the narrowing portion 34*b* at 2.90 or more, recording can be carried out stably at high speed while the maximum volume required for an ink droplet to be sprayed is securely obtained.

(3) Furthermore, by forming the narrowing portions 34*b* along the flat surface of the supply plate 34, the length ratio (L2/L1) can be set at 0.34 or more easily.

(4) Still further, since the head unit 30 has a structure in which a plurality of plates are laminated, the nozzles, the common ink chambers, the narrowing portions, and the pressure chambers can be produced easily; in particular, the narrowing portions 34*b* having a desired pressure loss can be formed easily.

[Other Embodiments]

(1) Although an inkjet recording apparatus is taken as an example of the droplet spraying apparatus according to the present invention, the present invention is applicable to apparatuses for spraying liquids other than ink as a matter of course.

(2) In addition, the present invention is also applicable to an inkjet recording apparatus that uses a specific ink of only one color.

(3) Furthermore, the present invention is also applicable to a recording apparatus that sprays ink droplets using pressure change due to bubbles generated inside ink by supplying thermal energy to the inside of the ink or using the displacement of a vibration plate by virtue of static electricity.

(4) Although the inkjet recording apparatus according to the above-mentioned embodiment has a configuration in which both the narrowing portion 34*b* and the through hole 34*a* are formed inside the supply plate 34, it may also be possible to have a configuration in which only the narrowing portion 34*b* is formed in the supply plate 34 and a spacer plate in which only the through hole 34*a* is formed is disposed below the supply plate 34 or a configuration in which the narrowing portion is formed in the lower surface of the base plate 32.

What is claimed is:

1. A liquid droplet spraying apparatus, comprising:

a plurality of nozzles that spray liquid droplets;

a plurality of pressure chambers respectively connected to the plurality of nozzles, the pressure chambers each configured to store liquid to which spraying pressure is selectively applied;

a common liquid chamber that stores the liquid to be supplied to the plurality of pressure chambers; and a plurality of narrowing portions, each including a first opening at one end thereof, which couples with the common liquid chamber, and a second opening at the other end thereof, which couples with a respective one of the pressure chambers, to supply the liquid from the common liquid chamber to the plurality of pressure chambers, the narrowing portions being larger in a pressure loss than the common liquid chamber and the plurality of pressure chambers;

wherein a ratio of a length of each of the narrowing portions in a liquid flowing direction with respect to a length of a corresponding one of the pressure chambers in the liquid flowing direction is 0.34 or more, the liquid flowing direction corresponding to a direction in which the liquid flows through the narrowing portions; and wherein the length of each of the narrowing portions is defined as a minimal length between the first opening and the second opening.

2. The liquid droplet spraying apparatus according to claim 1;

wherein a ratio of a width to a depth of each narrowing portion is 2.9 or more.

3. The liquid droplet spraying apparatus according to claim 1, further comprising:

a cavity plate that defines the plurality of pressure chambers;

a manifold plate that defines the common liquid chamber; and a supply plate laminated between the cavity plate and the manifold plate, the supply plate defining the narrowing portions;

wherein the supply plate has a flat surface along which the narrowing portions are formed; and each of the narrowing portions has one end coupled to the common liquid chamber and the other end coupled to the corresponding one of the pressure chambers.

4. The liquid droplet spraying apparatus according to claim 3, further comprising:

a nozzle plate that defines the plurality of nozzles, the nozzle plate disposed on an opposite side of the supply plate with respect to the manifold plates.

5. The liquid droplet spraying apparatus according to claim 3, further comprising:

a base plate laminated with the supply plate;

wherein the narrowing portions are respectively formed into a groove shape on the supply plate and covered by the base plate such that the base plate defines the narrowing portions along with the supply plate; and the supply plate defines a plurality of through holes, each through hole coupling a respective narrowing portions to the common liquid chamber at the one end thereof, or to the corresponding one of the pressure chambers at the other end thereof.

6. A liquid droplet spraying apparatus, comprising:

a plurality of nozzles that spray liquid droplets;

a plurality of pressure chambers, each including a first through hole which couples with a respective one of the plurality of nozzles and a second through hole, the pressure chambers each being configured to store liquid to which spraying pressure is selectively applied;

a common liquid chamber that stores the liquid to be supplied to the plurality of pressure chambers, the common liquid chamber including third through holes which couple with respective ones of the second through holes of the pressure chambers; and a plurality of narrowing portions that respectively connect the second through holes and the third through holes to supply the liquid from the common liquid chamber to the plurality of pressure chambers, the narrowing portions being larger in a pressure loss than the common liquid chamber and the plurality of pressure chambers;

wherein each of the narrowing portions is shorter in length than the pressure chamber in a liquid flowing direction, the liquid flowing direction corresponding to a direction in which the liquid flows through the narrowing potions; and wherein a ratio of a width to a depth of each narrowing portion is 2.9 or more.

7. The liquid droplet spraying apparatus according to claim 6, further comprising:

a cavity plate that defines the plurality of pressure chambers;

a manifold plate that defines the common liquid chamber; and a supply plate laminated between the cavity plate and the manifold plate, the supply plate defining the narrowing portions;

wherein the supply plate has a flat surface along which the narrowing portions are formed; and each of the narrowing portions has one end coupled to the common liquid chamber and the other end coupled to a corresponding one of the pressure chambers.

8. The liquid droplet spraying apparatus according to claim 7, further comprising:

a nozzle plate that defines the plurality of nozzles, the nozzle plate disposed on an opposite side of the supply plate with respect to the manifold plates.

9. The liquid droplet spraying apparatus according to claim 7, further comprising:

a base plate laminated with the supply plate;

wherein the narrowing portions are respectively formed into a groove shape on the supply plate and covered by the base plate such that the base plate defines the narrowing portions along with the supply plate; and the supply plate defines a through hole, the through hole coupling the narrowing portion to the common liquid chamber at the one end thereof, or to the corresponding one of the pressure chambers at the other end thereof.

10. A liquid droplet spraying apparatus, comprising:

a plurality of nozzles that spray liquid droplets;

a plurality of pressure chambers, each including a first through hole which couples with a respective one of the plurality of nozzles and a second through hole, the pressure chambers each being configured to store liquid to which spraying pressure is selectively applied;

a common liquid chamber that stores the liquid to be supplied to the plurality of pressure chambers, the common liquid chamber including third through holes, each of which couples with a respective one of the second through holes of the pressure chambers; and a plurality of narrowing portions that respectively connect the second through holes and the third through holes to supply the liquid from the common liquid chamber to the plurality of pressure chambers, the narrowing portions being larger in a pressure loss than the common liquid chamber and the plurality of pressure chambers;

wherein a ratio of a length of each of the narrowing portions in a liquid flowing direction with respect to a length of corresponding one of the pressure chambers in the liquid flowing direction is 0.34 or more, the liquid flowing direction corresponding to a direction in which the liquid flows through the narrowing portions.

* * * * *